US010867745B2

(12) United States Patent
Zhang et al.

(10) Patent No.: US 10,867,745 B2
(45) Date of Patent: Dec. 15, 2020

(54) INDUCTOR STRUCTURE AND METHOD FOR FORMING THE SAME

(71) Applicants: Futurewei Technologies, Inc., Plano, TX (US); University of Florida Research Foundation, Inc., Gainesville, FL (US)

(72) Inventors: Huan Zhang, Gainesville, FL (US); Heping Dai, Plano, TX (US); Shuo Wang, Gainesville, FL (US)

(73) Assignees: Futurewei Technologies, Inc., Plano, TX (US); University of Florida Research Foundation, Incorporated, Gainesville, FL (US)

( * ) Notice: Subject to any disclaimer, the term of this patent is extended or adjusted under 35 U.S.C. 154(b) by 0 days.

(21) Appl. No.: 15/653,805

(22) Filed: Jul. 19, 2017

(65) Prior Publication Data

US 2019/0027303 A1 Jan. 24, 2019

(51) Int. Cl.

| | |
|---|---|
| ***H01F 21/08*** | (2006.01) |
| ***H01F 27/38*** | (2006.01) |
| ***H01F 3/14*** | (2006.01) |
| ***H01F 27/28*** | (2006.01) |
| ***H01F 41/02*** | (2006.01) |

(52) U.S. Cl.

CPC ..... *H01F 27/38* (2013.01); *H01F 3/14* (2013.01); *H01F 27/2804* (2013.01); *H01F 41/0206* (2013.01)

(58) Field of Classification Search

USPC ..... 336/165, 170, 173, 178, 184, 212, 221

See application file for complete search history.

(56) References Cited

U.S. PATENT DOCUMENTS

| | | | | |
|---|---|---|---|---|
| 1,553,983 | A * | 9/1925 | Casper | D06F 41/00 336/171 |
| 5,422,619 | A * | 6/1995 | Yamaguchi | H01F 17/04 336/181 |
| 2001/0020886 | A1* | 9/2001 | Matsumoto | H01F 19/04 336/200 |
| 2011/0279210 | A1* | 11/2011 | Ono | H01F 27/2852 336/192 |
| 2014/0292461 | A1* | 10/2014 | Inoue | H01F 27/24 336/178 |

FOREIGN PATENT DOCUMENTS

| | | |
|---|---|---|
| CN | 103269149 A | 8/2013 |
| CN | 105163489 A | 12/2015 |
| CN | 105895332 A | 8/2016 |

* cited by examiner

*Primary Examiner* — Elvin G Enad
*Assistant Examiner* — Kazi S Hossain
(74) *Attorney, Agent, or Firm* — Slater Matsil, LLP

(57) ABSTRACT

A device comprises a magnetic core comprising a first leg and a second leg formed by a first magnetic component and a second magnetic component, wherein a first gap and a second gap are placed between the first magnetic component and the second magnetic component and are in the first leg and the second leg, respectively, a first winding wound around the first leg in a counter-clockwise direction and a second winding wound around the second leg in a clockwise direction.

10 Claims, 9 Drawing Sheets

INDUCTOR STRUCTURE AND METHOD FOR FORMING THE SAME

TECHNICAL FIELD

The present disclosure relates to an inductor, and particularly to an apparatus and method for an inductor with low near field radiation.

BACKGROUND

Magnetic devices include transformers, inductors and the like. A magnetic device typically includes a magnetic core formed of suitable magnetic materials such as ferrite, powder iron and/or the like. The magnetic device may further include a conductive winding or a plurality of conductive windings. The windings and the current flowing through the windings may generate a magnetic field, which is also known as magnetic flux. In a normal design, the magnetic core usually has a relatively high permeability in comparison with the surrounding medium (e.g., air). As a result, the magnetic flux is confined with the magnetic core, which is a closed flux path. The magnetic flux provides a medium for storing, transferring or releasing electromagnetic energy.

Inductors are widely used in the power electronics industry. An inductor may comprise a winding wound around a magnetic core (e.g., a toroid core). The winding generates a magnetic force, which drives a magnetic field or flux. The main flux generated by the winding is confined with the magnetic core.

The magnetic material of the magnetic core of an inductor may be of a magnetic permeability greater than that of the surrounding medium (e.g., air). However, the coupling between the winding and the magnetic core is not perfect. There may be a leakage path between the winding and the surrounding medium having a lower magnetic permeability. The coupling between the winding the surrounding medium may generate a leakage magnetic flux.

SUMMARY

These and other problems are generally solved or circumvented, and technical advantages are generally achieved, by preferred embodiments of the present disclosure which provide an inductor having low near field radiation.

In accordance with an embodiment, an apparatus comprises a magnetic core comprising a first leg and a second leg formed by a first magnetic component and a second magnetic component, wherein a first gap is in the first leg and placed between the first magnetic component and the second magnetic component, a first winding wound around the first leg and a second winding wound around the second leg, wherein the first winding and the second winding are configured to flow a current and generate a first magnetic flux in the first leg and a second magnetic flux in the second leg and the first magnetic flux generated by the first winding and the second magnetic flux generated by the second winding are in opposite directions.

In accordance with another embodiment, a method comprises forming a first opening and a second opening in a printed circuit board, wherein the first opening and the second opening are configured to accommodate a first leg and a second leg of a magnetic core, respectively, placing a first trace between the first opening and the second opening, splitting the first trace into a second trace wound around the first opening in a counter-clockwise direction and a third trace wound around the second opening in a clockwise direction, wherein the second trace ends at a first via and the third trace ends at a second via, placing a fourth trace between the first opening and the second opening, wherein the fourth trace starts from the first via and the second via and splitting the fourth trace into a fifth trace wound around the first opening in the counter-clockwise direction and a sixth trace wound around the second opening in the clockwise direction, wherein the fifth trace ends at a third via and the sixth trace ends at a fourth via.

In accordance with yet another embodiment, a device comprises a first magnetic core comprising a first leg and a second leg formed by a first magnetic component and a second magnetic component, wherein a first gap and a second gap are placed between the first magnetic component and the second magnetic component and are in the first leg and the second leg, respectively and a first winding wound around the first leg in a counter-clockwise direction.

An advantage of an embodiment of the present disclosure is an inductor having low near field radiation.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosure, and do not limit the scope of the disclosure.

The present disclosure will be described with respect to preferred embodiments in a specific context, namely a low leakage inductor used in power converters or power systems with tight EMI requirements. The disclosure may also be applied, however, to a variety of power converters or power systems including isolated power converters (e.g., forward converters), non-isolated power converters (e.g., buck converters), filter circuits, linear regulators, AC/DC systems (e.g., power factor correction circuits) and the like. Hereinafter, various embodiments will be explained in detail with reference to the accompanying drawings.

Figure 1:
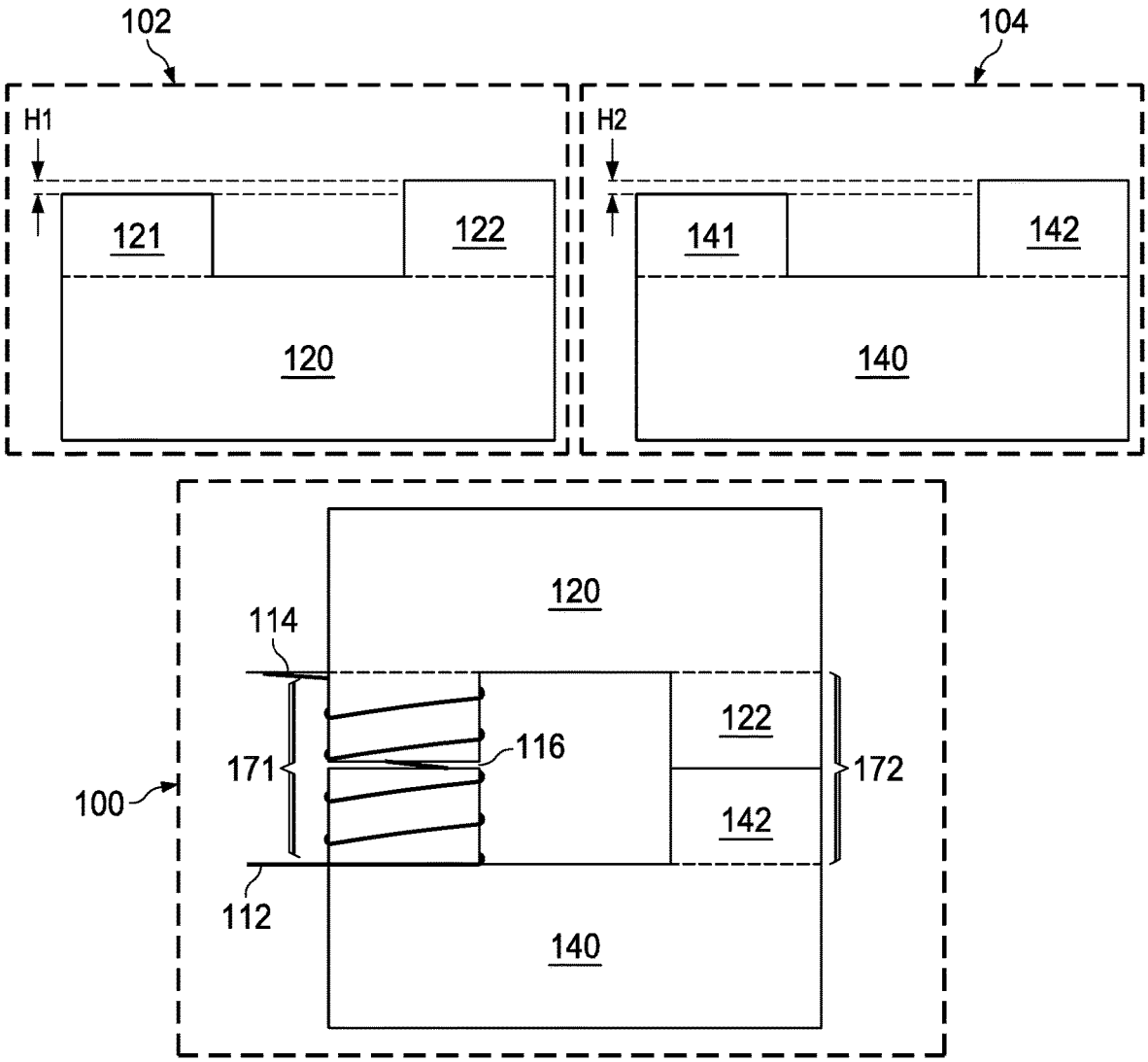
FIG. 1 illustrates an inductor having an air gap in accordance with various embodiments of the present disclosure.

FIG. 1 illustrates an inductor having an air gap in accordance with various embodiments of the present disclosure. The inductor 100 comprises a magnetic core formed by a first magnetic component 102 and a second magnetic component 104. In some embodiments, the first magnetic component 102 is a first U-shaped core. The second magnetic component 104 is a second U-shaped core. In alternative embodiments, the first magnetic component 102 and the second magnetic component 104 may be implemented as other suitable magnetic cores such as EI cores, PQ cores and the like.

The first magnetic component 102 comprises a first base 120, a first post 121 and a second post 122. Likewise, the second magnetic component 104 comprises a second base 140, a third post 141 and a fourth post 142.

As shown in FIG. 1, the height of the second post 122 is greater than the height of the first post 121. The height difference between the first post 121 and the second post 122 is defined as H1. In some embodiments, H1 is in a range from about 0.1 mm to about 1 mm.

As shown in FIG. 1, the height of the fourth post 142 is greater than the height of the third post 141. The height difference between the fourth post 142 and the third post 141 is defined as H2. In some embodiments, H2 is in a range from about 0.1 mm to about 1 mm.

It should be noted that the dimensions (e.g., H1 and H2) used above are selected purely for demonstration purposes and are not intended to limit the various embodiments of the present disclosure to any particular size dimensions. A person skilled in the art would understand the dimensions (e.g., the height difference H1) may vary depending on different design needs and applications.

Suitable materials such as adhesives may be used to bond the first magnetic component 102 and the second magnetic component 104 together. During a bonding process, the first magnetic component 102 is placed against the second magnetic component 104. In particular, the second post 122 is in contact with the fourth post 142. A suitable adhesive may be placed between the second post 122 and the fourth post 142 to bond the first magnetic component 102 and the second magnetic component 104 together. As shown in FIG. 1, due to the height differences H1 and H2, there is an air gap 116 between the first post 121 and the third post 141.

As shown in FIG. 1, after the first magnetic component 102 has been bonded on the second magnetic component 104, the magnetic core comprises two legs, namely a first leg 171 and a second leg 172. The first leg 171 is formed by the first post 121 and the third post 141, and connected between the first base 120 and the second base 140. The air gap 116 is in the first leg 171.

The second leg 172 is formed by the second post 122 and the fourth post 142, and connected between the first base 120 and the second base 140. There may be some adhesive materials at the interface between the second post 122 and the fourth post 142. The adhesive materials may function as a thin air gap between the second post 122 and the fourth post 142. Such a thin air gap has a limited impact on the electrical and magnetic characteristics of the inductor 100. As such, for the sake of simplicity, the air gap generated by the adhesive materials is omitted throughout the description.

In accordance with an embodiment, the magnetic core of the inductor 100 is made of a magnetic material having high permeability such as ferrite, powder iron, other power suitable materials, any combinations thereof and/or the like. In accordance with an embodiment, the magnetic core is made of ferrite or the like. In particularly, when the inductor 100 is used in high frequency applications, the inductor 100 made of ferrite may generate low energy losses. On the other hand, in accordance with another embodiment, the inductor 100 is made of powder iron or other powder metal materials. In low frequency applications, the inductor 100 made of powder iron is selected because a powder iron core may have a greater saturation flux density than a corresponding ferrite core.

The inductor 100 has one winding wound around the magnetic core as shown in FIG. 1. The winding starts from a first terminal 112 and ends at a second terminal 114. The winding is wound around the first leg 171, which has the air gap 116. As shown in FIG. 1, the winding has five turns. The first turn is wound around the third post 141 and over the second base 140. The fifth turn of the winding is wound around the first post 121 and below the first base 120. The winding is within the leg portion (e.g., the first leg 171) of the magnetic core.

It should be noted that the winding and the air gap 116 are located at the same leg of the magnetic core when the magnetic core has only one air gap. It should further be noted while FIG. 1 illustrates the inductor 100 with five turns, the inductor 100 could accommodate any number of turns.

It should further be noted the winding shown in FIG. 1 is merely an example, which should not unduly limit the scope of the claims. One of ordinary skill in the art would recognize many variations, alternatives, and modifications.

For example, the winding shown in FIG. 1 may be replaced by a plurality of traces and vias formed in a printed circuit board.

Figure 2:
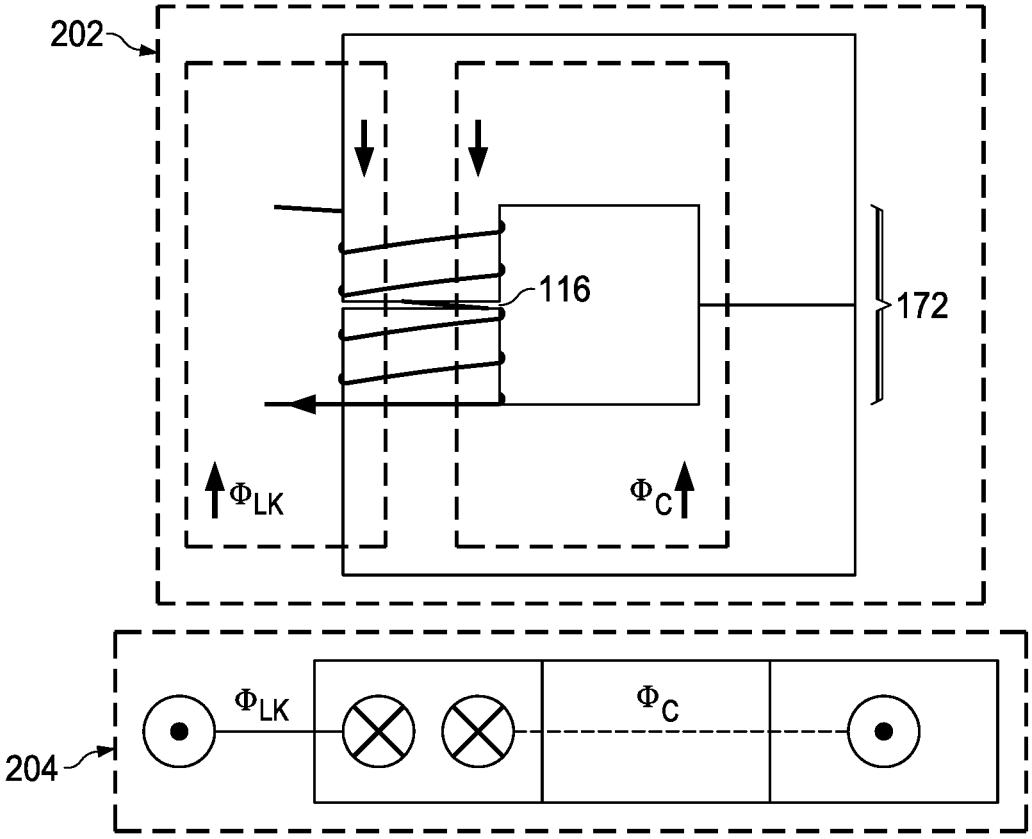
FIG. 2 illustrates a magnetic circuit conducting a main magnetic flux and a leakage magnetic flux respectively in accordance with various embodiments of the present disclosure.

FIG. 2 illustrates a magnetic circuit conducting a main magnetic flux and a leakage magnetic flux respectively in accordance with various embodiments of the present disclosure. The inductor structure of FIG. 2 is similar to that shown in FIG. 1. For avoiding repetition, the structure of the inductor shown in FIG. 2 is not described in detail herein.

The magnetic material of the magnetic core may be of a magnetic permeability greater than that of a surrounding medium (e.g., air). However, the coupling between the winding and the magnetic core may be not perfect. The coupling between the winding and the surrounding medium may generate a leakage magnetic flux.

A view 202 shows a first magnetic flux flows through the magnetic core and a second magnetic flux flows through the free air after a current flows through the winding of the magnetic core. The first magnetic flux is alternatively referred to as the main magnetic flux throughout the description. The second magnetic flux is alternatively referred to as the leakage magnetic flux throughout the description. As shown in FIG. 2, in the leg having the air gap 116, the direction of the main magnetic flux is the same as the direction of the leakage magnetic flux.

A view 204 shows a top view of the magnetic core. The cross indicates the magnetic flux flows into a plane and the dot indicates the magnetic flux flows out of the plane. From the top view 204, the main magnetic flux $\Phi_C$ and the leakage magnetic flux $\Phi_{LK}$ flow into the leg having the air gap 116. The main magnetic flux flows out of the leg not having the air gap. The main magnetic flux $\Phi_C$ is in a closed loop path formed by the magnetic core and the air gap 116. The direction of the leakage magnetic flux in the free air has a dot.

Figure 3:
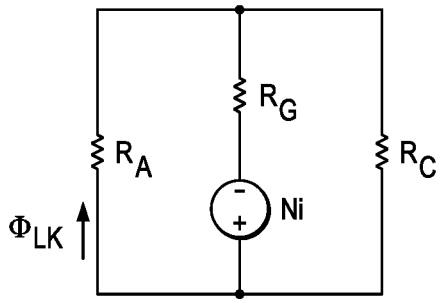
FIG. 3 illustrates a magnetic equivalent circuit of the inductor shown in FIG. 2 in accordance with various embodiments of the present disclosure.

FIG. 3 illustrates a magnetic equivalent circuit of the inductor shown in FIG. 2 in accordance with various embodiments of the present disclosure. A magnetomotive force Ni is generated by the winding shown in FIG. 2 after a current flows into the winding. A first reluctance $R_C$ is modeled based upon the magnetic characteristics of the magnetic core (illustrated in FIG. 2). A second reluctance $R_G$ is modeled based upon the magnetic characteristics of the air gap 116 (illustrated in FIG. 2). A third reluctance $R_A$ is modeled based upon the magnetic characteristics of the surrounding medium such as air.

In some embodiments, by employing magnetic circuit theory similar to Ohm's law in electrical circuit theory, the leakage magnetic flux can be defined as the follows:

$$\phi_{LK} = \frac{Ni}{\frac{R_A \cdot R_G}{R_C} + R_G + R_A} \tag{1}$$

The equation above shows that the leakage magnetic flux can be very small as long as $R_A$ is much greater than $R_C$ and $R_G$ is much greater than $R_C$. This can be satisfied by selecting a high permeability core material.

Figure 4:
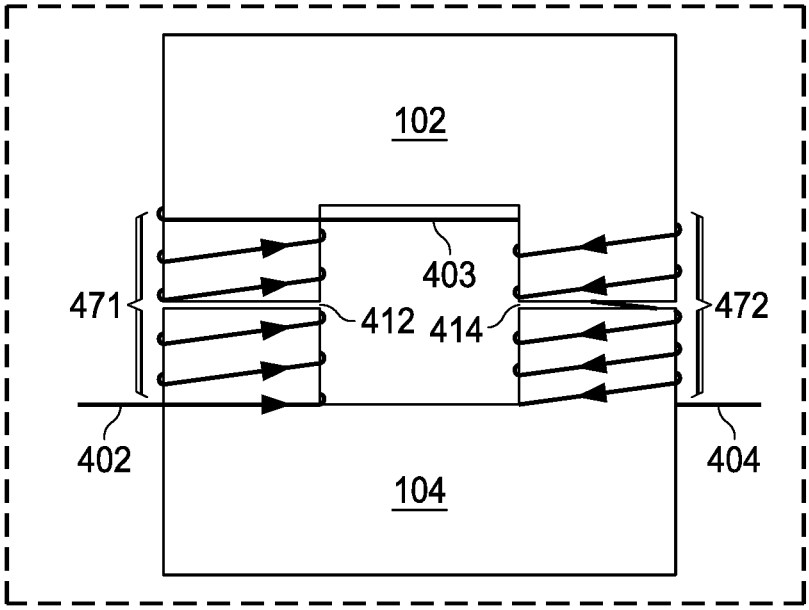
FIG. 4 illustrates an inductor having two air gaps in accordance with various embodiments of the present disclosure.

FIG. 4 illustrates an inductor having two air gaps in accordance with various embodiments of the present disclosure. The magnetic core shown in FIG. 4 is similar to that shown in FIG. 1 except that each leg of the magnetic core has an air gap. As shown in FIG. 4, a first air gap 412 is placed in a first leg 471 of the magnetic core. A second air gap 414 is placed in a second leg 472 of the magnetic core. In some embodiments, a height of the first air gap is approximately equal to a height of the second air gap.

It should be noted the air gaps shown in FIG. 4 are selected purely for demonstration purposes and are not intended to limit the various embodiments of the present disclosure to any particular air gaps. One of ordinary skill in the art would recognize many variations, alternatives, and modifications. For example, suitable gap spacers may be placed between two halves of the magnetic core to create the air gaps. Furthermore, the magnetic core may be implemented as powder cores having distributed air gaps.

The winding of the inductor includes two portions. A first portion of the winding starts from a first terminal 402 and ends at an internal terminal 403. A second portion of the winding starts from the internal terminal 403 and ends at a second terminal 404. The first portion of the winding and the second portion of the winding are connected in series through the internal terminal 403.

As shown in FIG. 4, the first portion of the winding is wound around the first leg 471 of the magnetic core. The first portion of the winding has five turns. From a top view, the first portion of the winding is wound around the first leg 471 in a counter-clockwise direction. The second portion of the winding is wound around the second leg 472 of the magnetic core. The second portion of the winding has five turns. From the top view, the second portion of the winding is wound around the second leg 472 in a clockwise direction.

Figure 5:
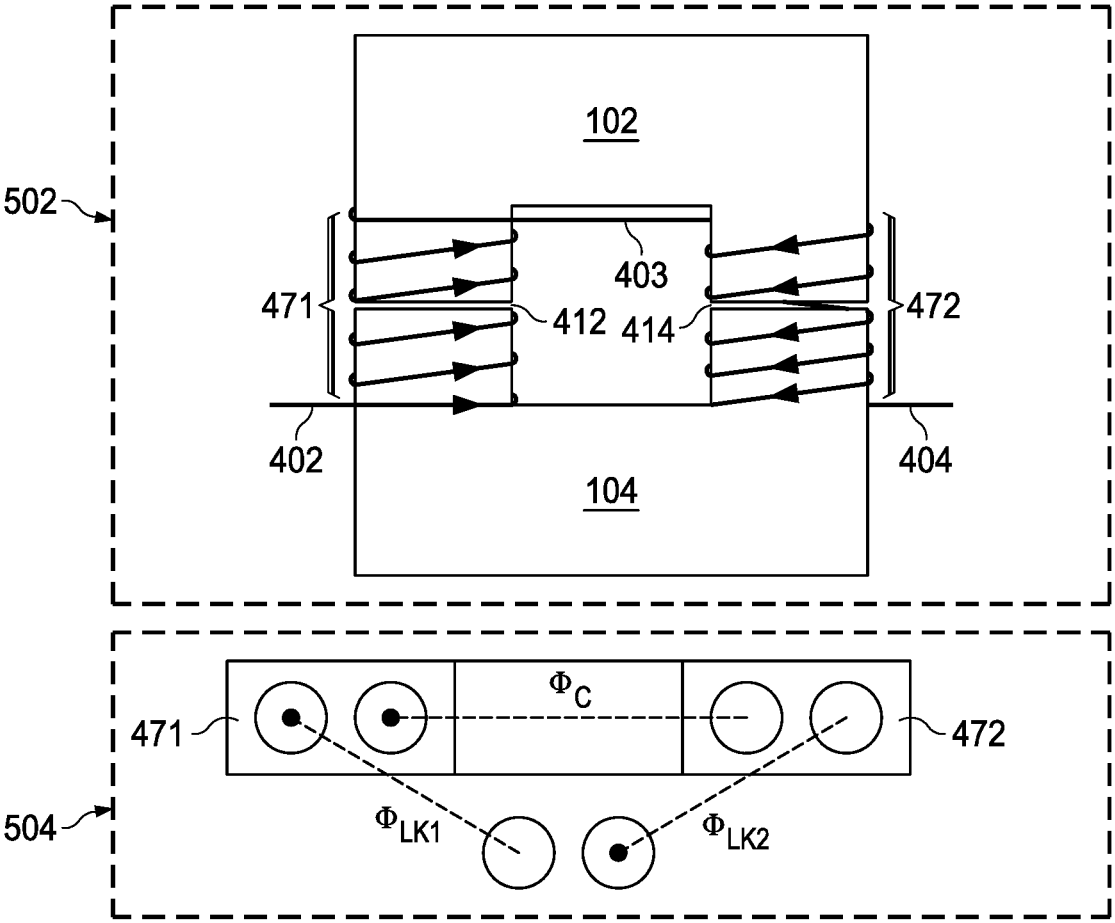
FIG. 5 illustrates a magnetic circuit conducting a main magnetic flux and two leakage magnetic fluxes in accordance with various embodiments of the present disclosure.

FIG. 5 illustrates a magnetic circuit conducting a main magnetic flux and two leakage magnetic fluxes in accordance with various embodiments of the present disclosure. The inductor structure of FIG. 5 is similar to that shown in FIG. 4. For avoiding repetition, the structure of the inductor shown in FIG. 5 is not described in detail herein.

A first view 502 shows the current flowing through the first portion of the winding and the current flowing through the second portion of the winding are in opposite directions. As a result, the corresponding magnetic fluxes generated by these two portions of the winding are in opposite directions. After the winding of the inductor is configured to conduct a current, a main magnetic flux $\Phi_C$ is generated in a closed loop path formed by the magnetic core and two air gaps 412 and 414. At a point outside the magnetic core, there may be two leakage magnetic fluxes generated by the two portions of the winding of the inductor. In particular, a first leakage magnetic flux $\Phi_{LK1}$ is generated through the coupling between the first portion of the winding and the surrounding medium. Likewise, a second leakage magnetic flux $\Phi_{LK2}$ is generated through the coupling between the second portion of the winding and the surrounding medium.

A second view 504 shows the flux directions. In the first leg 471, both the main magnetic flux and the first leakage magnetic flux go out of the plane as indicated by the dots. In the second leg 472, both the main magnetic flux and the second leakage magnetic flux enter into the place as indicated by the crosses.

The main magnetic fluxes in the first leg 471 and the second leg 472 form a closed loop within the magnetic core. Outside the magnetic core, the first leakage magnetic flux $\Phi_{LK1}$ and the second leakage magnetic flux $\Phi_{LK2}$ are in opposite directions. As a result the first leakage magnetic flux $\Phi_{LK1}$ and the second leakage magnetic flux $\Phi_{LK2}$ are canceled out at a point outside the inductor.

One advantageous feature of the inductor shown in FIG. 5 is the near field radiation of the inductor is reduced as a result of the cancellation of the first leakage magnetic $\Phi_{LK1}$ flux and the second leakage magnetic flux $\Phi_{LK2}$. Such reduced near field radiation helps to reduce the strength of the magnetic field adjacent to the inductor. As a result, the inductor can satisfy the tight electromagnetic interference (EMI) requirements.

Figure 6:
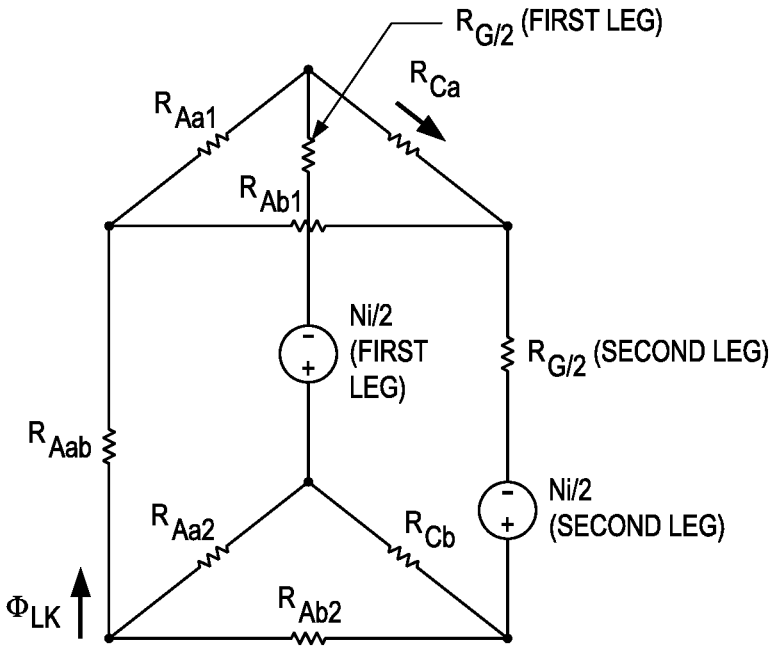
FIG. 6 illustrates a magnetic equivalent circuit of the inductor shown in FIG. 5 in accordance with various embodiments of the present disclosure.

FIG. 6 illustrates a magnetic equivalent circuit of the inductor shown in FIG. 5 in accordance with various embodiments of the present disclosure. The winding of the inductor shown in FIG. 5 has N turns. These N turns are split between the first portion wound around the first leg 471 and the second portion wound around the second leg 472.

A first magnetomotive force Ni/2 from the first leg is generated by the first portion of the winding. A second magnetomotive force Ni/2 from the second leg is generated by the second portion of the winding. As shown in FIG. 6, the first magnetomotive force and the second magnetomotive force are in opposite directions.

A first reluctance $R_{Ca}$ and a second reluctance $R_{Cb}$ are modeled based upon the magnetic characteristics of the magnetic core. A third reluctance $R_G/2$ from the first leg and a fourth reluctance $R_G/2$ from the second leg are modeled based upon the magnetic characteristics of the air gaps 412 and 414 respectively. A fifth reluctance $R_{Aa1}$, a sixth reluctance $R_{Aa2}$, a seventh reluctance $R_{Ab1}$, an eighth reluctance $R_{Ab2}$ and a ninth reluctance $R_{Aab}$ are modeled based upon the magnetic characteristics of the surrounding medium such as air.

By selecting a high permeability core material, the reluctances from the air gaps and the surrounding medium can be much greater than the reluctances from the magnetic core. That is, $R_{Ca}$ and $R_{Cb}$ are small enough to create short circuits of the two magnetomotive forces. As shown in FIG. 6, the two magnetomotive forces are out of phase because of the opposite current directions shown in FIG. 5.

In some embodiments, by employing superposition theorem, the total leakage magnetic flux is the sum of the first leakage magnetic flux $\Phi_{LK1}$ and the second leakage magnetic flux $\Phi_{LK2}$. The total leakage magnetic flux is approximately equal to zero because the first leakage magnetic flux $\Phi_{LK1}$ and the second leakage magnetic flux $\Phi_{LK2}$ are canceled out. More particularly, the total leakage magnetic flux at a point outside the inductor equals the sum of the fluxes produced by the two magnetomotive forces. Since the two magnetomotive forces are out of phase, the first leakage magnetic flux $\Phi_{LK1}$ and the second leakage magnetic flux $\Phi_{LK2}$ are canceled out and the total leakage magnetic flux is approximately equal to zero.

Figure 7:
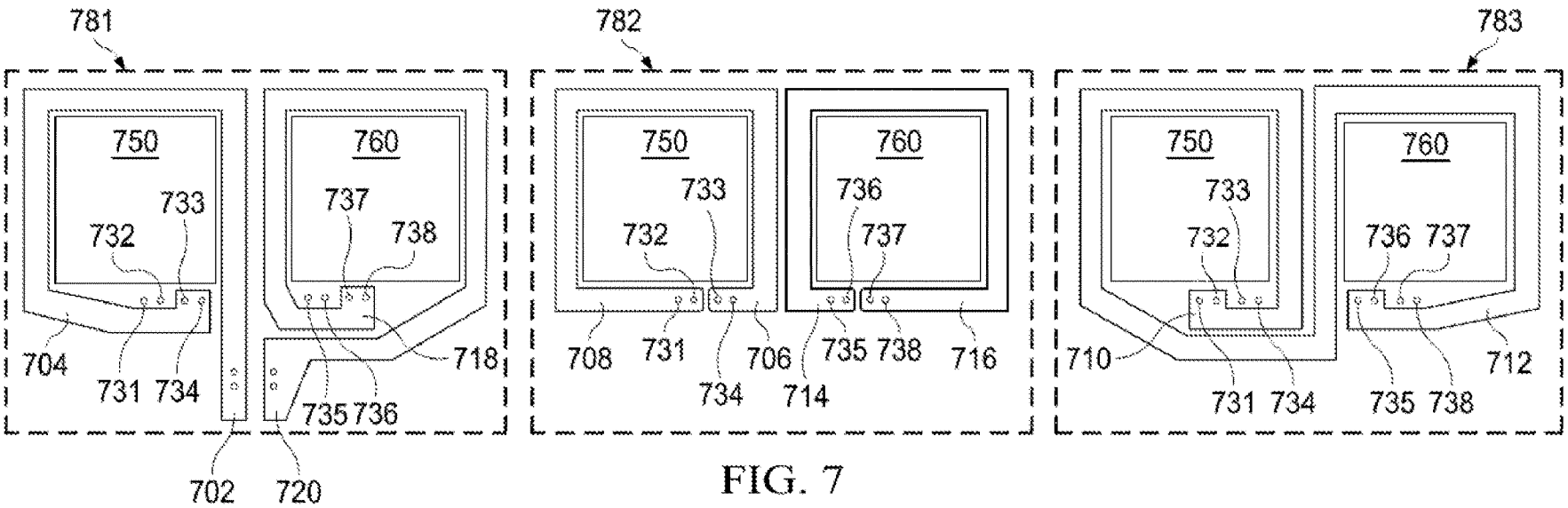
FIG. 7 illustrates an implementation of the winding of the inductor shown in FIG. 5 on a printed circuit board in accordance with various embodiments of the present disclosure.

FIG. 7 illustrates an implementation of the winding of the inductor shown in FIG. 5 on a printed circuit board in accordance with various embodiments of the present disclosure. A printed circuit board comprises a plurality of layers. A first opening 750 and a second opening 760 are formed in the printed circuit board. In some embodiments, the first opening 750 and the second opening 760 are used to accommodate the first leg 471 and the second leg 472 of the inductor shown in FIG. 5, respectively.

A view 781 shows a layout on a first layer of the printed circuit board. A view 782 shows a layout on a second layer of the printed circuit board. A view 783 shows a layout on a third layer of the printed circuit board. In some embodiments, the second layer is on top of the first layer. The third layer is on top of the second layer.

It should be noted that while each view of FIG. 7 shows a layer of the printed circuit board, the single layer can be replaced by a plurality of layers connected in parallel. For example, the printed circuit board may include twelve layers. The layer shown in the view 781 is formed by four layers connected in parallel. In other words, each layer of the four layers has the same layout and internal vias connect these four layers together.

Referring back to FIG. 5, the inductor in FIG. 5 may have a large number of turns. Depending on different design needs and applications, the number of turns of the inductor may vary. FIG. 7 illustrates the layout of an inductor having six turns.

The winding of the inductor starts at a first terminal 702 and ends at a second terminal 720. On the first layer, the winding is wound around the first opening 750 in a counter-clockwise direction. The winding ends at a first pad 704. As shown in FIG. 7, the first pad 704 is connected with a second pad 706 of the second layer through two vias 733 and 734. On the second layer, the winding starts from the second pad 706 and ends at a third pad 708. On the second layer, the winding is wound around the first opening 750 in the counter-clockwise direction. The third pad 708 is connected with a fourth pad 710 of the third layer through two vias 731 and 732.

On the third layer, the winding starts from the fourth pad 710. The winding is wound around the first opening 750 in the counter-clockwise direction, and then wound around the second opening 760 in a clockwise direction. On the third layer, there are two turns. On the left side, a first turn is wound around the first opening 750. On the right side, a second turn is wound around the second opening 760. These two turns are connected in series. As shown in FIG. 7, the winding on the third layer ends at a fifth pad 712. The fifth pad 712 is connected with a sixth pad 714 of the second layer through two vias 735 and 736.

On the second layer, the winding starts from the sixth pad 714 and ends at a seventh pad 716. On the second layer, the winding is wound around the second opening 760 in the clockwise direction. The seventh pad 716 is connected with an eighth pad 718 of the first layer through two vias 737 and 738.

On the first layer, the winding starts from the eighth pad 718 and ends at the second terminal 720. On the first layer, the winding is wound around the second opening 760 in the clockwise direction.

As shown in FIG. 7, each layer includes two turns. The turn wound around the first opening 750 and the turn wound around the second opening 760 are wound in opposite directions. Furthermore, on each layer, a portion of the turn wound around the first opening 750 is immediately adjacent to and in parallel with and a portion of the turn would around the second opening 760. These two portions occupy the space between the first opening 750 and the second opening 760.

As shown in FIG. 7, the vias include two groups. A first group includes vias 731, 732, 733 and 734, which are placed in a row. A second group includes vias 735, 736, 737 and 738, which are placed in a row. Furthermore, the vias 731-737 are horizontally aligned to each other.

It should be noted that FIG. 7 illustrates only two vias connecting two pads in different layers. The number of vias illustrated herein is limited solely for the purpose of clearly illustrating the inventive aspects of the various embodiments. The present disclosure is not limited to any specific number of vias.

Figure 8:
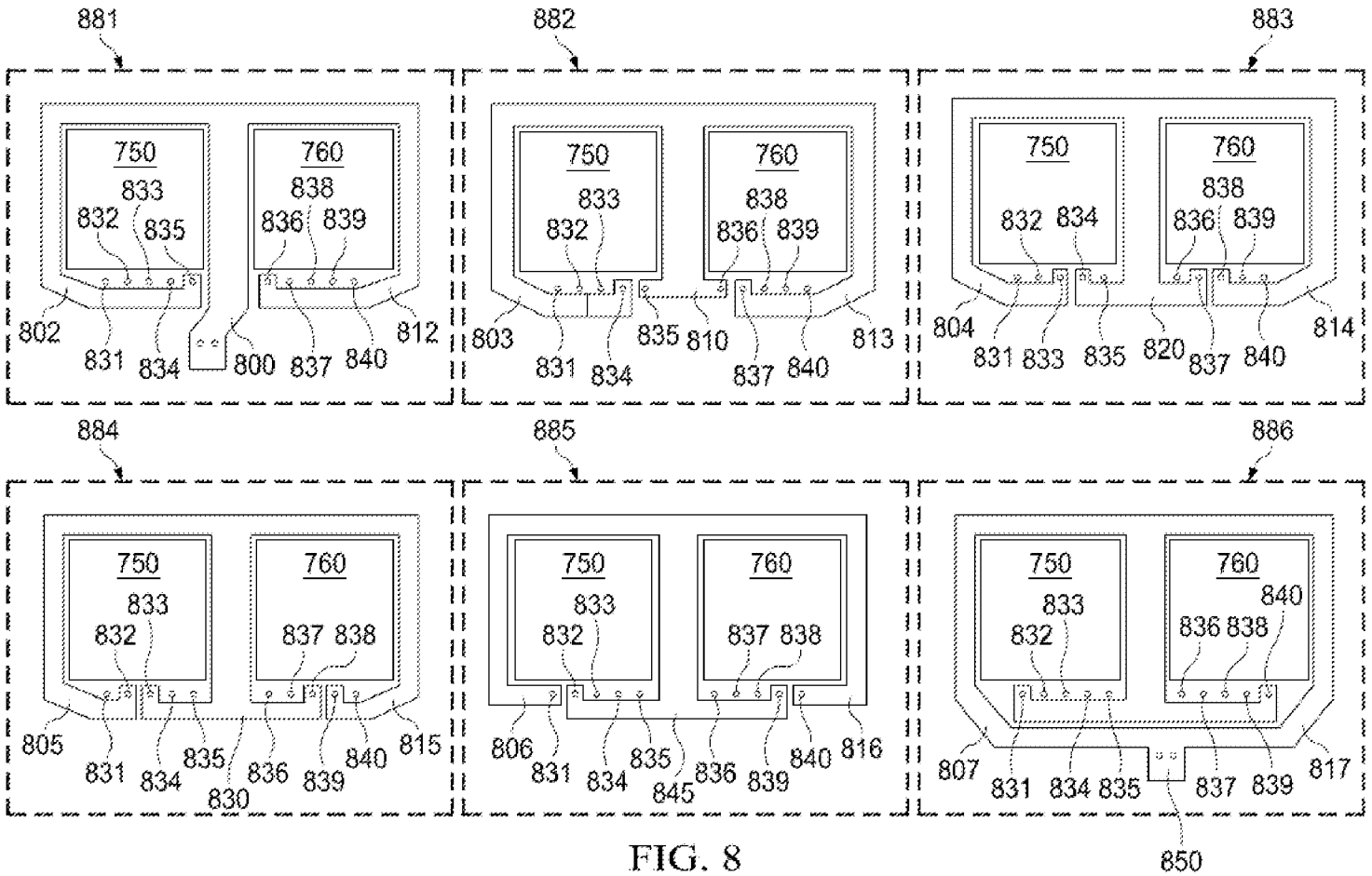
FIG. 8 illustrates another implementation of the winding of an inductor having two legs on a printed circuit board layout in accordance with various embodiments of the present disclosure.

FIG. 8 illustrates another implementation of the winding of an inductor having two legs on a printed circuit board layout in accordance with various embodiments of the present disclosure. The printed circuit board shown in FIG. 8 is similar to that shown in FIG. 7 except that it has six layers. It should be noted each layer shown in FIG. 8 can be replaced by a plurality of layers connected in parallel. For example, the printed circuit board may include twelve layers. The layer shown in the layer 881 is formed by two layers connected in parallel.

In some embodiments, the inductor is formed by two windings. A first winding has six turns wound around the first opening 750 in a counter-clockwise direction. A second winding has six turns wound around the second opening 760 in a clockwise direction. The first winding and the second winding are connected in parallel. The printed circuit board has six layers. On each layer, there are two turns.

On a first layer 881, a first trace starts from a first terminal 800 and splits into a second trace wound around the first opening 750 in a counter-clockwise direction and a third trace wound around the second opening 760 in a clockwise direction. As shown in FIG. 8, the second trace ends at a first pad 802 and the third trace ends at a second pad 812. The first pad 802 is connected with a third pad 810 of the second layer 882 through via 835. Likewise, the second pad 812 is connected with the third pad 810 of the second layer 882 through via 836.

On the second layer 882, a fourth trace starts from the third pad 810 and splits into a fifth trace wound around the first opening 750 in the counter-clockwise direction and a sixth trace wound around the second opening 760 in the clockwise direction. As shown in FIG. 8, the fifth trace ends at a fourth pad 803 and the sixth trace ends at a fifth pad 813.

On layers 883, 884, 885 and 886, the layouts are similar to the layouts on the layers 881 and 882. More particularly, a trace starts from a pad (e.g., pads 830, 845 and 850) and splits into two traces. A first trace is wound around the first opening 750 in the counter-clockwise direction and a second trace is wound around the second opening 760 in the clockwise direction. A plurality of vias 831, 832, 833, 834, 835, 836, 837, 838, 839 and 840 is employed to connect the pads in different layers.

Figure 9:
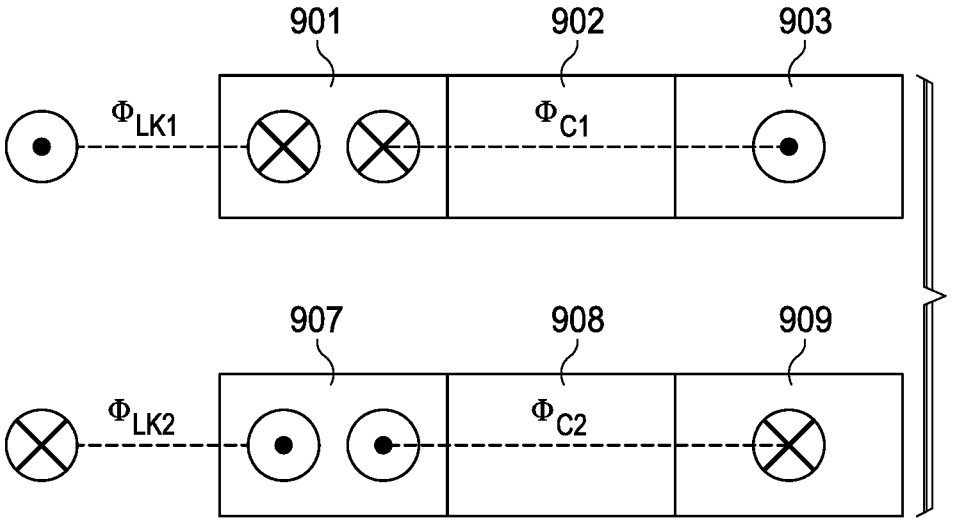
FIG. 9 illustrates a top view of an inductor device formed by two inductors in accordance with various embodiments of the present disclosure.

FIG. 9 illustrates a top view of an inductor device formed by two inductors in accordance with various embodiments of the present disclosure. A first inductor 902 is placed immediately adjacent to a second inductor 908. From the top view, the first inductor 902 and the second inductor 908 are placed in parallel. The magnetic core of the first inductor 902 has two legs 901 and 903. Likewise, the magnetic core of the second inductor 908 has two legs 907 and 909.

In some embodiments, the first inductor 902 and the second inductor 908 have a magnetic core structure similar to that shown in FIGS. 5-6. The windings of the first inductor 902 and the second inductor 908 have a structure similar to that shown in FIGS. 1-2. In other words, the magnetic core of each inductor has two air gaps. The winding is only wound around one leg of the inductor.

In some embodiments, the winding of the first inductor 902 is only wound around the leg 901. The winding of the second inductor 908 is only wound around the leg 907. The current flowing through the winding of the first inductor 902 and the current flowing through the winding of the second inductor 908 are in opposite directions.

As shown in FIG. 9, the main magnetic flux $\Phi_{C1}$ generated in the leg 901 of the first inductor 902 and the main magnetic flux $\Phi_{C2}$ generated in the leg 907 of the second inductor 908 are in opposite directions. Likewise, the leakage magnetic flux $\Phi_{LK1}$ generated by the winding wound around the leg 901 of the first inductor 902 and the leakage magnetic flux $\Phi_{LK2}$ generated by the winding wound around the leg 907 of the second inductor 908 are in opposite directions. Since the fluxes in two adjacent legs are out of phase, the leakage fluxes outside the inductor device may be partially canceled out.

In some embodiments, the winding of the first inductor 902 and the winding of the second inductor 908 are connected in series.

One advantageous feature of having the inductor structure shown in FIG. 9 is the inductor structure may function as a common mode inductor to better attenuate common mode noise.

Figure 10:
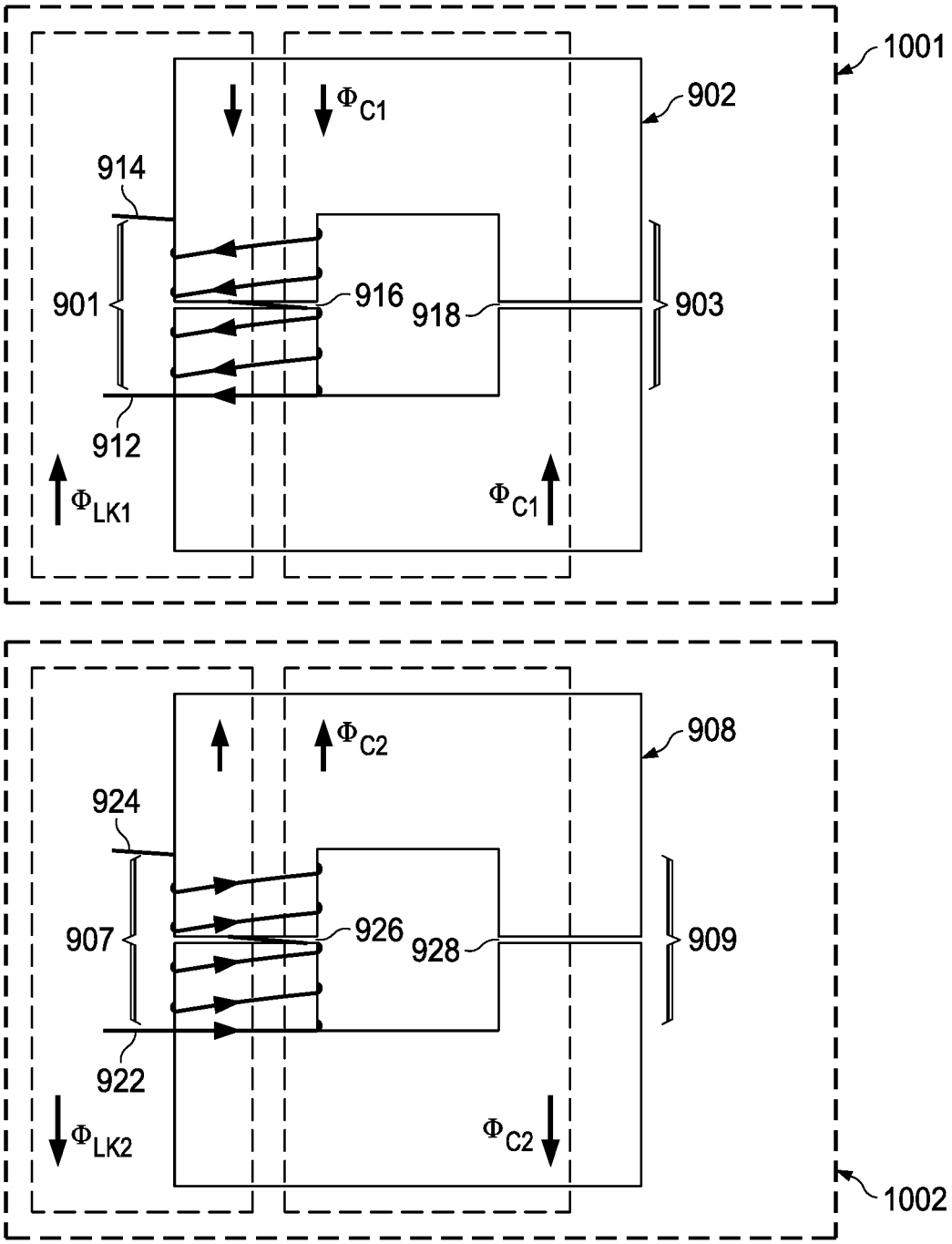
FIG. 10 illustrates front-side views of the inductor device shown in FIG. 9 in accordance with various embodiments of the present disclosure.

FIG. 10 illustrates front-side views of the inductor device shown in FIG. 9 in accordance with various embodiments of the present disclosure. A first view 1001 shows a front-side view of the first inductor 902. A second view 1002 shows a front-side view of the second inductor 908.

As shown in the first view 1001, the first inductor 902 includes two air gaps. A first air gap 916 is in the leg 901. A second air gap 918 is in the leg 903. A winding is wound around the leg 901 as shown in FIG. 10. A current flows through the winding from a first terminal 914 to a second terminal 912. The current flowing through the winding generates a first main magnetic flux $\Phi_{C1}$ and a first leakage magnetic flux $\Phi_{LK1}$ The first main magnetic flux $\Phi_{C1}$ is confined with the magnetic core, which is a closed flux path. The first leakage magnetic flux $\Phi_{LK1}$ flows through the free air.

As shown in the second view 1002, the second inductor 908 includes two air gaps. A first air gap 926 is in the leg 907. A second air gap 928 is in the leg 909. A winding is wound around the leg 907 as shown in FIG. 10. A current flows through the winding from a third terminal 922 to a fourth terminal 924. The current flowing through the winding generates a second main magnetic flux $\Phi_{C2}$ and a second leakage magnetic flux $\Phi_{LK2}$. The second main magnetic flux $\Phi_{C2}$ is confined with the magnetic core, which is a closed flux path. The second leakage magnetic flux $\Phi_{LK2}$ flows through the free air.

As shown in FIG. 10, the current in the winding of the first inductor 902 and the current in the winding of the second inductor 908 are in opposite directions. As a result, the first main magnetic flux $\Phi_{C1}$ generated in the leg 901 of the first inductor 902 and the second main magnetic flux $\Phi_{C2}$ generated in the leg 907 of the second inductor 908 are in opposite directions. Likewise, the first leakage magnetic flux $\Phi_{LK1}$ generated by the winding wound around the leg 901 of the first inductor 902 and the second leakage magnetic flux $\Phi_{LK2}$ generated by the winding wound around the leg 907 of the second inductor 908 are in opposite directions. Since the fluxes in two adjacent legs (shown in FIG. 9) are out of phase, the leakage fluxes outside the inductor device may be partially canceled out.

Figure 11:
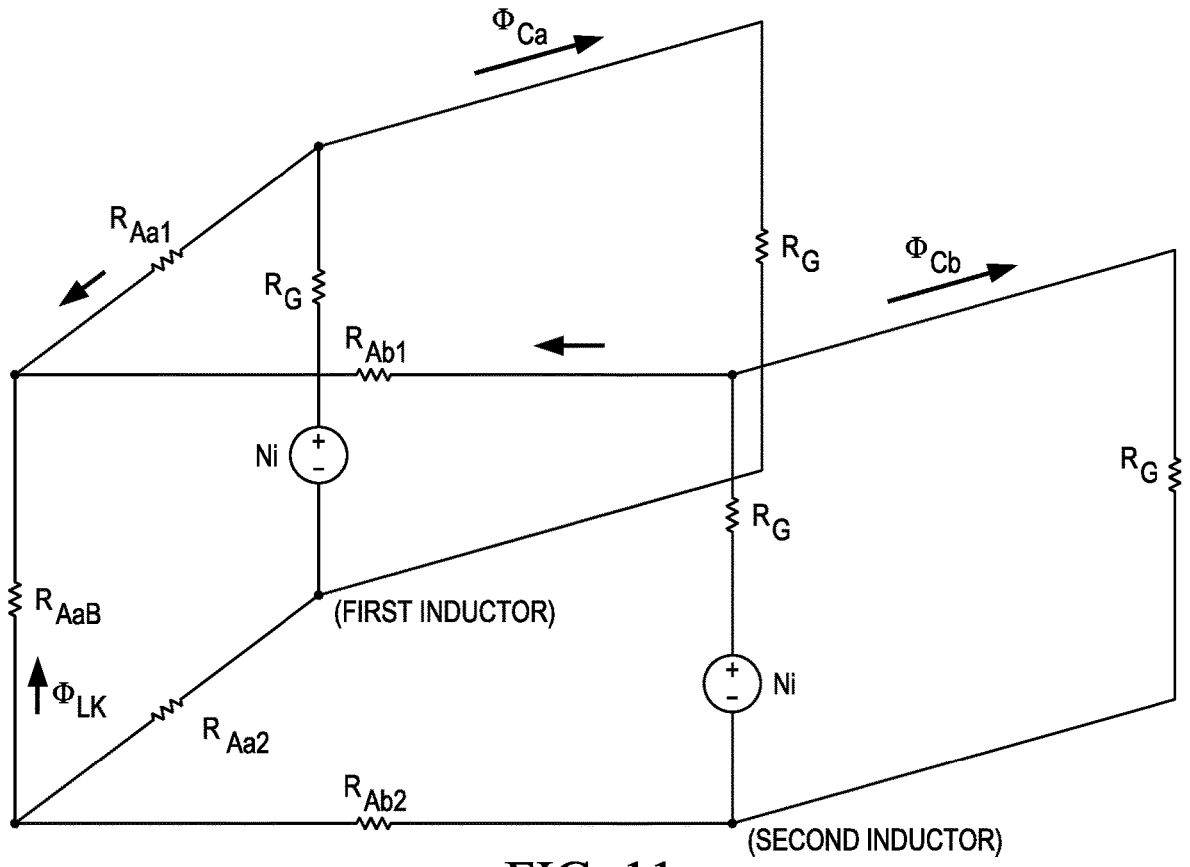
FIG. 11 illustrates a magnetic equivalent circuit of the inductor device shown in FIG. 9 in accordance with various embodiments of the present disclosure.

FIG. 11 illustrates a magnetic equivalent circuit of the inductor device shown in FIG. 9 in accordance with various embodiments of the present disclosure. Since inductors 902 and 908 are formed on two separate magnetic cores, the magnetic equivalent circuit shown in FIG. 10 includes two separate portions. A first portion is formed by the first inductor 902. A second portion is formed by the second inductor 908. The reluctances and the magnetomotive forces shown in FIG. 10 are similar to those shown in FIG. 6, and hence are not discussed in further detail herein.

In some embodiments, the leakage fluxes outside the inductor device may be fully canceled out when $R_{Aa1}$ is equal to $R_{Ab1}$, and $R_{Aa2}$ is equal $R_{Ab2}$. Such a reluctance relationship can be satisfied when a leakage flux observation point is located at a centerline of the two inductors. Otherwise, the leakage fluxes outside the inductor device may be partially canceled out.

One advantageous feature of having the inductor structures shown in FIGS. 1, 4 and 9 is the inductor structures are able to reduce the near field radiation. In comparison with a conventional inductor device having two air gaps in two legs and a winding wound around one leg, the inductor structures shown in FIGS. 1, 4 and 9 can improve the near field radiation. At a point about 7 cm away from the inductor device and about 0 cm in a z direction perpendicular to the plane where the inductor is placed, the near field radiation is reduced by about 17 dB when the inductor structure shown in FIG. 1 is employed. The near field radiation is reduced by about 32 dB when the inductor structure shown in FIG. 4 is employed and the winding is implemented as the layout shown in FIG. 7. The near field radiation is reduced by about 30 dB when the inductor structure shown in FIG. 4 is employed and the winding is implemented as the layout shown in FIG. 8. Furthermore, the near field radiation is reduced by about 10 dB when the inductor structure shown in FIG. 9 is employed.

Figure 12:
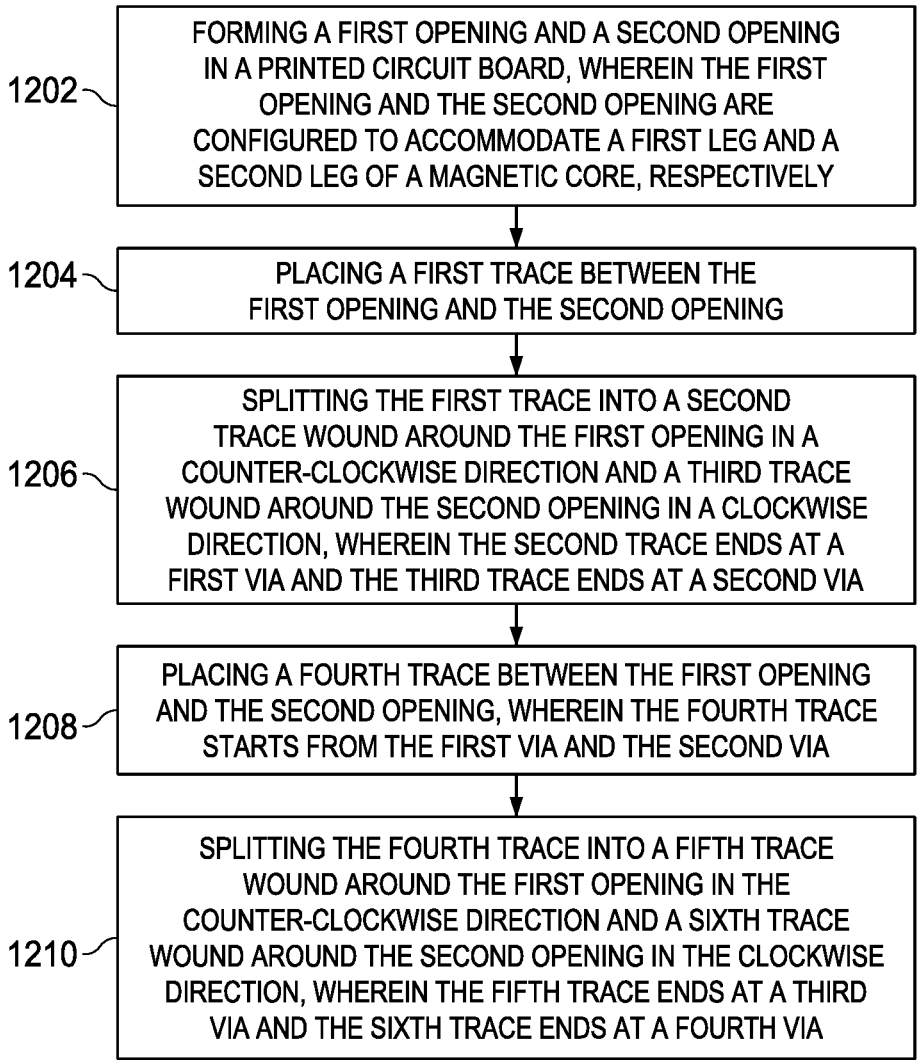
FIG. 12 illustrates a flow chart of a method for forming the layout of the inductor shown in FIG. 8 in accordance with various embodiments of the present disclosure.

FIG. 12 illustrates a flow chart of a method for forming the layout of the inductor shown in FIG. 8 in accordance with various embodiments of the present disclosure. This flowchart shown in FIG. 12 is merely an example, which should not unduly limit the scope of the claims. One of ordinary skill in the art would recognize many variations, alternatives, and modifications. For example, various steps illustrated in FIG. 12 may be added, removed, replaced, rearranged and repeated.

At step 1202, a first opening and a second opening are formed in a printed circuit board. In some embodiments, the first opening and the second opening are configured to accommodate a first leg and a second leg of a magnetic core, respectively. The first opening and the second opening are shown in FIG. 8 (e.g., openings 750 and 760).

At step 1204, a first trace is placed between the first opening and the second opening, such as illustrated in FIG. 8 (e.g., the trace between the first opening 750 and the second opening 760 on the layer 881).

At step 1206, the first trace is split into a second trace wound around the first opening in a counter-clockwise direction and a third trace wound around the second opening in a clockwise direction, such as illustrated in FIG. 8 (e.g., the traces wound around the first opening 750 and the second opening 760 on the layer 881). The second trace ends at a first via and the third trace ends at a second via (e.g., vias 835 and 836 on the layer 881).

At step 1208, a fourth trace is placed between the first opening and the second opening, such as illustrated in FIG. 8 (e.g., the trace between the first opening 750 and the second opening 760 on the layer 882). The fourth trace starts from the first via and the second via.

At step 1210, the fourth trace is split into a fifth trace wound around the first opening in the counter-clockwise direction and a sixth trace wound around the second opening in the clockwise direction (e.g., the traces wound around the first opening 750 and the second opening 760 on the layer 882). The fifth trace ends at a third via and the sixth trace ends at a fourth via (e.g., vias 834 and 837 on the layer 882).

Although embodiments of the present disclosure and its advantages have been described in detail, it should be understood that various changes, substitutions and alterations can be made herein without departing from the spirit and scope of the disclosure as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An apparatus comprising:

a magnetic core comprising a first leg and a second leg formed by a first magnetic component and a second magnetic component, wherein a first gap is in the first leg and placed between the first magnetic component and the second magnetic component and wherein the first magnetic component is a first U-core, and the second magnetic component is a second U-core;

a first winding wound around the first leg; and a second winding wound around the second leg, and wherein:

the first winding and the second winding are connected in series and form an inductor;

the first winding and the second winding are configured to flow a current and generate a first magnetic flux in the first leg and a second magnetic flux in the second leg; and the first magnetic flux generated by the first winding and the second magnetic flux generated by the second winding are in opposite directions, and a first leakage flux generated by the first winding and a second leakage flux generated by the second winding cancel out each other, and wherein the first winding and the second winding are formed by a first trace and a second trace, and wherein the first trace starts from a first terminal on a first layer of a printed circuit board and splits into a first printed circuit board trace wound around the first leg of the magnetic core in a counter-clockwise direction and a second printed circuit board trace wound around the second leg of the magnetic core in a clockwise direction, and the second trace on a second layer of the printed circuit board starts from a first pad connected to the first layer, and the second trace splits into a third printed circuit board trace wound around the first leg of the magnetic core in the counter-clockwise direction and a fourth printed circuit board trace wound around the second leg of the magnetic core in the clockwise direction.

2. The apparatus of claim 1, further comprising:

a second gap in the second leg and placed between the first magnetic component and the second magnetic component.

3. The apparatus of claim 2, wherein:

a height of the first gap is approximately equal to a height of the second gap.

4. The apparatus of claim 1, wherein:

the number of turns of the first winding is equal to the number of turns of the second winding.

5. The apparatus of claim 1, wherein:

the magnetic core is formed of ferrite.

6. A device comprising:

a magnetic core comprising a first leg and a second leg, wherein the magnetic core is formed by two U-cores;

a first gap in the first leg;

a second gap in the second leg;

a first winding wound around the first leg of the magnetic core in a counter-clockwise direction; and a second winding wound around the second leg of the magnetic core in a clockwise direction, wherein the first winding and the second winding form an inductor, and a first leakage flux generated by the first winding and a second leakage flux generated by the second winding cancel out each other, and wherein the first winding and second winding are formed by a first trace and a second trace, and wherein the first trace starts from a first terminal on a first layer of a printed circuit board and splits into a first printed circuit board trace wound around the first leg of the magnetic core in the counter-clockwise direction and a second printed circuit board trace wound around the second leg of the magnetic core in the clockwise direction, and the second trace on a second layer of the printed circuit board starts from a first pad connected to the first layer, and the second trace splits into a third printed circuit board trace wound around the first leg of the magnetic core in the counter-clockwise direction and a fourth printed circuit board trace wound around the second leg of the magnetic core in the clockwise direction.

7. The device of claim 6, wherein:

the first leg and the second leg is formed by a first magnetic component and a second magnetic component, wherein the first gap is placed between the first magnetic component and the second magnetic component.

8. The device of claim 6, wherein:

the first winding and the second winding are configured to flow a current and generate a first magnetic flux in the first leg and a second magnetic flux in the second leg; and the first magnetic flux generated by the first winding and the second magnetic flux generated by the second winding are in opposite directions.

9. The device of claim 6, wherein:

the first printed circuit board trace ends at a first via and the second printed circuit board trace ends at a second via; and the third printed circuit board trace ends at a third via and the fourth printed circuit board trace ends at a fourth via.

10. The device of claim 9, wherein:

the second via and the fourth via are located immediately adjacent to each other; and the first via and the third via are located immediately adjacent to each other, and wherein the first via, the second via, the third via and the fourth via are horizontally aligned to each other.

* * * * *